US007900918B2

(12) United States Patent
Ono et al.

(10) Patent No.: US 7,900,918 B2
(45) Date of Patent: Mar. 8, 2011

(54) SHEET CONVEYING SYSTEM, AS WELL AS IMAGE FORMING APPARATUS AND SHEET CONVEYING APPARATUS THEREOF

(75) Inventors: Toru Ono, Toyota (JP); Kiyoshi Okamoto, Moriya (JP); Noriaki Matsui, Abiko (JP)

(73) Assignee: Canon Kabushiki Kaisha (JP)

( * ) Notice: Subject to any disclaimer, the term of this patent is extended or adjusted under 35 U.S.C. 154(b) by 666 days.

(21) Appl. No.: 11/861,813

(22) Filed: Sep. 26, 2007

(65) Prior Publication Data

US 2008/0073833 A1 Mar. 27, 2008

(30) Foreign Application Priority Data

Sep. 27, 2006 (JP) ..... 2006-262720

(51) Int. Cl.
*B65H 5/02* (2006.01)

(52) U.S. Cl. ..... 271/273

(58) Field of Classification Search ..... 271/272–274, 271/314

See application file for complete search history.

(56) References Cited

U.S. PATENT DOCUMENTS 4,558,373 A * 12/1985 Plasencia et al. ..... 358/484
6,816,229 B2 * 11/2004 Oono ..... 355/18
7,422,209 B2 * 9/2008 Hashimoto ..... 271/228
2003/0155706 A1 * 8/2003 Tsutoh ..... 271/272
2005/0067775 A1 * 3/2005 Ono ..... 271/272

FOREIGN PATENT DOCUMENTS

JP 5-270694 A 10/1993
JP 9-77299 A 3/1997
JP 11-208939 A 8/1999

* cited by examiner

*Primary Examiner* — Stefanos Karmis
*Assistant Examiner* — Thomas A Morrison
(74) *Attorney, Agent, or Firm* — Rossi, Kimms & McDowell LLP

(57) ABSTRACT

A sheet conveying system in which when a sheet is passed from a sheet conveying apparatus to another, each including a sheet conveyance controller, the receiving apparatus can smoothly control acceleration, deceleration, or stop of conveyance of the sheet. A first sheet conveying device includes a first conveying roller pair to nip and convey a sheet, a releasing mechanism to release nipping of the sheet by the first conveying roller pair, and a first controller to control the first conveying roller pair and the releasing mechanism. A second sheet conveying device includes a second conveying roller pair to nip and convey the sheet conveyed by the first sheet conveying device, a second controller to control the second conveying roller pair, and a detecting device to detect position of a sheet. In response to the detection by the detecting device, the second controller causes the releasing mechanism to release the nipping of the sheet by the first conveying roller pair.

4 Claims, 10 Drawing Sheets

SHEET CONVEYING SYSTEM, AS WELL AS IMAGE FORMING APPARATUS AND SHEET CONVEYING APPARATUS THEREOF

BACKGROUND OF THE INVENTION

1. Field of the Invention

The present invention relates to a sheet conveying system, as well as an image forming apparatus and a sheet conveying apparatus thereof, more particularly, to a sheet conveying system in which multiple sheet conveying apparatuses, each having a conveying roller pair which conveys sheets, are coupled together as in a configuration in which an image forming apparatus such as a copying machine or a printer is coupled with an optional apparatus, as well as an image forming apparatus and a sheet conveying apparatus thereof.

2. Description of the Related Art

In some sheet conveying apparatuses in which a plurality of conveying roller pairs nip and convey a sheet, a conveying roller pair on the downstream side may control acceleration, deceleration, or stop the conveyance of the sheets.

In such an apparatus, if the conveying velocity of the conveying roller pair on the downstream side is lower than that on the upstream side, a sheet being conveyed can be looped and physical damage to the paper, such as a bend, can be caused.

On the contrary, if the conveying velocity of the conveying roller pair on the downstream side is higher than that on the upstream side, both ends of a sheet is pulled in the opposite directions with respect to the conveying direction and the sheet would be torn.

To avoid these problems, techniques have been proposed including a technique that, while conveying roller pairs on the both of the upstream and downstream sides are nipping a sheet, a conveying roller pair on the upstream side has a one-way clutch so as to prevent the both ends of a sheet from pulling and a technique that controls to release the nipping of the sheet by separating the conveying roller pair on the upstream side (for example, see Japanese Laid-Open Patent Publication (Kokai) NO. 11-208939, No. 09-077299, and No. 05-270694).

However, the use of the one-way clutch for the conveying roller pair causes roller traces left on the surface of the sheet, which deteriorates image formed on the sheet.

Further, in the above conventional technique, the separation of the conveying roller pair on the upstream side is controlled having regard to only the fact that all the conveying roller pairs included in one sheet conveying apparatus are controlled by one controller in the sheet conveying apparatus. That is, the technique does not consider controlling separation of the conveying roller pair on the upstream side, in the case where a plurality of sheet conveying apparatuses each having a controller and a conveying roller pair are coupled together.

Further, it may solve the above problems that the velocity of the conveying roller pair on the upstream side is controlled so as to synchronize with the velocity of that on the downstream side. However, when the various types of sheet conveying apparatuses, each having sheet conveyance control means, are coupled together in various combinations, it is difficult to control each of the conveying roller pairs in these sheet conveying apparatuses to bring acceleration and deceleration of their conveying velocities into synchronization with each other.

SUMMARY OF THE INVENTION

The present invention provides a sheet conveying system in which when a sheet is passed from a sheet conveying apparatus to another, each having a sheet conveyance controller, the receiving apparatus can smoothly control acceleration, deceleration, or stop of conveyance of the sheet, as well as an image forming apparatus and sheet conveying apparatus thereof.

According to a first aspect of the present invention, there is provided a sheet conveying system comprising a first sheet conveying device including a first conveying roller pair adapted to nip and convey a sheet, a releasing mechanism adapted to release nipping of the sheet by the first conveying roller pair, and a first controller adapted to control the first conveying roller pair and the releasing mechanism, and a second sheet conveying device including a second conveying roller pair adapted to nip and convey the sheet conveyed by the first sheet conveying device, a second controller adapted to control the second conveying roller pair, and a detecting device adapted to detect position of a sheet, wherein in response to the detection by the detecting device, the second controller is adapted to cause the releasing mechanism to release the nipping of the sheet by the first conveying roller pair.

Thus, when a sheet is passed through a plurality of sheet conveying apparatuses of which each has a sheet conveyance controller, one of the sheet conveying apparatuses that receives the sheet can smoothly control acceleration, deceleration, or stop of conveyance of the sheet. Consequently, damage to sheets being conveyed, such as bends and tears of sheets, can be prevented.

The sheet conveying system can further comprise a communicating device adapted to communicate between the first controller and the second controller, wherein the second controller can be adapted to transmit an instruction of controlling the first controller to operate the releasing mechanism via the communicating device.

The releasing mechanism can be adapted to separate the first conveying roller pair to release the nipping of the sheet.

After the nipping of the sheet by the first conveying roller pair is released by the releasing mechanism, the second controller can be adapted to decelerate or stop the second conveying roller pair.

The first sheet conveying device can further include a third conveying roller pair disposed upstream from the first conveying roller pair and a second releasing mechanism adapted to release nipping of a sheet by the third conveying roller pair, and the second controller can be adapted to cause the second releasing mechanism to release nipping of a sheet by the third conveying roller pair when the releasing mechanism releases the nipping of the sheet by the first conveying roller pair.

The sheet conveying system can further comprise a size detecting device adapted to detect the size of the sheet, and wherein when the size of the sheet detected by the size detecting device is shorter than a distance from the first conveying roller pair to the third conveying roller pair, the second controller can be adapted to stop causing the second releasing mechanism to release the nipping of a sheet.

The sheet conveying system can further comprise a communicating device adapted to communicate between the second controller and the releasing mechanism, wherein the second controller can be adapted to communicate with the releasing mechanism via the communicating device to directly control thereof, without being adapted to communicate with the first controller.

According to a second aspect of the present invention, there is provided a sheet conveying system comprising a first sheet conveying device including a first conveying roller pair adapted to nip and convey a sheet, a releasing mechanism adapted to release nipping of the sheet by the first conveying roller pair, a first controller adapted to control the first conveying roller pair and the releasing mechanism, and a detecting device adapted to detect the sheet, a second sheet conveying device including a second conveying roller pair adapted to nip and convey the sheet from the first sheet conveying device to be conveyed, and a second controller adapted to control the second conveying roller pair, and a communicating device adapted to communicate between the first controller and the second controller, wherein the first controller is adapted to communicate with the second controller to estimate the time required to nip the sheet by the second conveying roller pair after the detecting device detects the sheet, and when the estimated time has elapsed after the detecting device detects the sheet, the first controller is adapted to cause the releasing mechanism to release the nipping of the sheet by the first conveying roller pair.

The first controller can be adapted to acquire distance information indicating a distance from a sheet inlet of the second sheet conveying device to the conveying roller pair to determine the time based the distance information.

According to a third aspect of the present invention, there is provided an image forming apparatus including a first roller pair adapted to nip and convey a sheet, a releasing mechanism adapted to release nipping of the sheet by the first conveying roller pair, and a first controller adapted to control the first conveying roller pair and the releasing mechanism, the image forming apparatus comprising a second conveying roller pair adapted to nip and convey the sheet conveyed by the first sheet conveying device, a second controller adapted to control the second conveying roller pair, and a detecting device adapted to detect a sheet, wherein in response to the detection by the detecting device, the second controller can be adapted to cause the releasing mechanism to release the nipping of the sheet by the first conveying roller pair.

According to a fourth aspect of the present invention, there is provided a sheet conveying apparatus including a sheet conveying apparatus connected with an image forming apparatus, a first conveying roller pair adapted to receive a sheet conveyed from the sheet conveying apparatus, a first controller adapted to control the first conveying roller pair, a detecting device adapted to detect a sheet, the sheet conveying apparatus comprising a second conveying roller pair adapted to nip and convey a sheet toward the image forming apparatus, a releasing mechanism adapted to release nipping of the sheet by the first conveying roller pair, a second controller adapted to control the second conveying roller pair and the releasing mechanism, and wherein the second controller can be adapted to cause the releasing mechanism to release the nipping of the sheet by the second conveying pair based on an instruction from the first controller in response to the detection by the detecting device.

Further features of the invention will become apparent from the following description of exemplary embodiments with reference to the attached drawings.

BRIEF DESCRIPTION OF THE DRAWINGS

FIG. 2A shows a state in which a sheet is being discharged, FIG. 2B shows a state in which the sheet is being fed, FIG. 2C shows a state in which a conveying roller pair is releasing the nipping of the sheet, and FIGS. 2D and 2E are flowcharts showing the procedure of a sheet passing process.

DESCRIPTION OF THE EMBODIMENTS

The present invention will now be described in detail with reference to the drawings showing preferred embodiments thereof. It should be noted that the relative arrangement of the components, the numerical expressions and numerical values set forth in these embodiments do not limit the scope of the present invention unless it is specifically stated otherwise.

Figure 1:
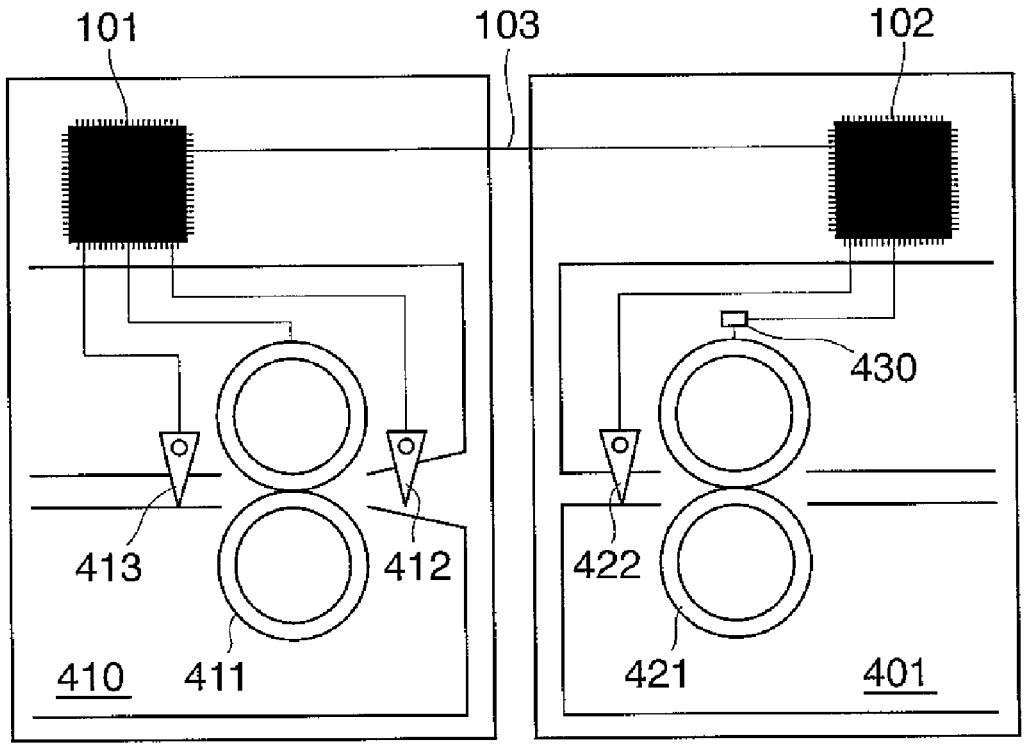
FIG. 1 is a diagram illustrating a sheet conveying system according to a first embodiment of the present invention.
Figure 2A:
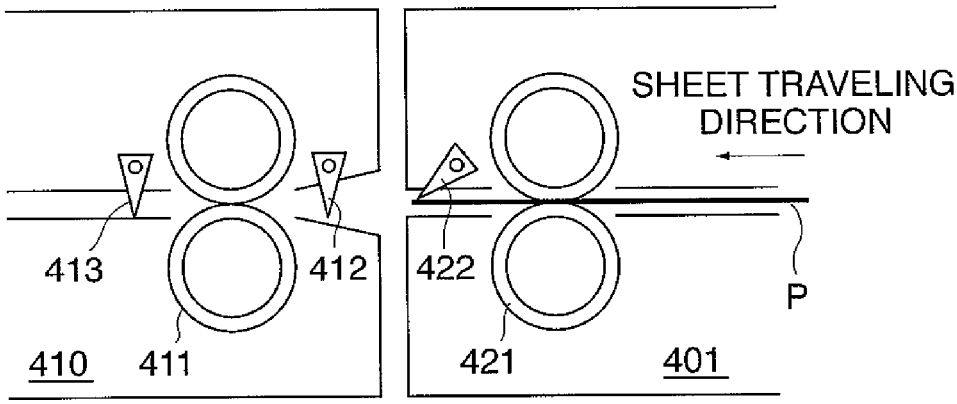
FIGS. 2A to 2E are diagrams illustrating an operation of the sheet conveying system shown in FIG. 1.
Figure 2B:
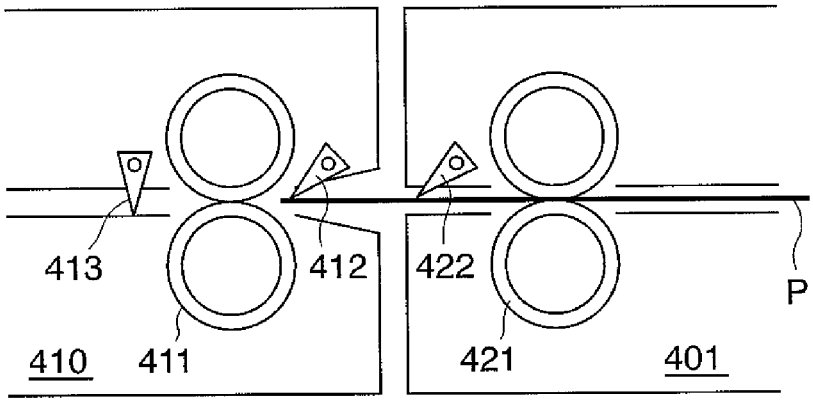
Figure 2C:
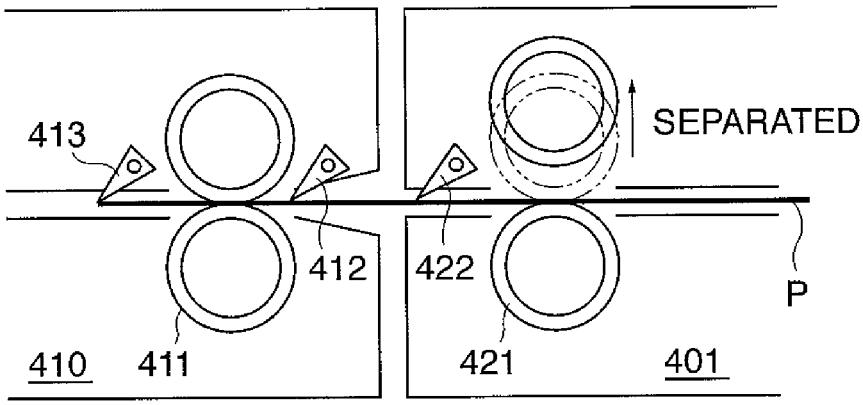
Figure 3:
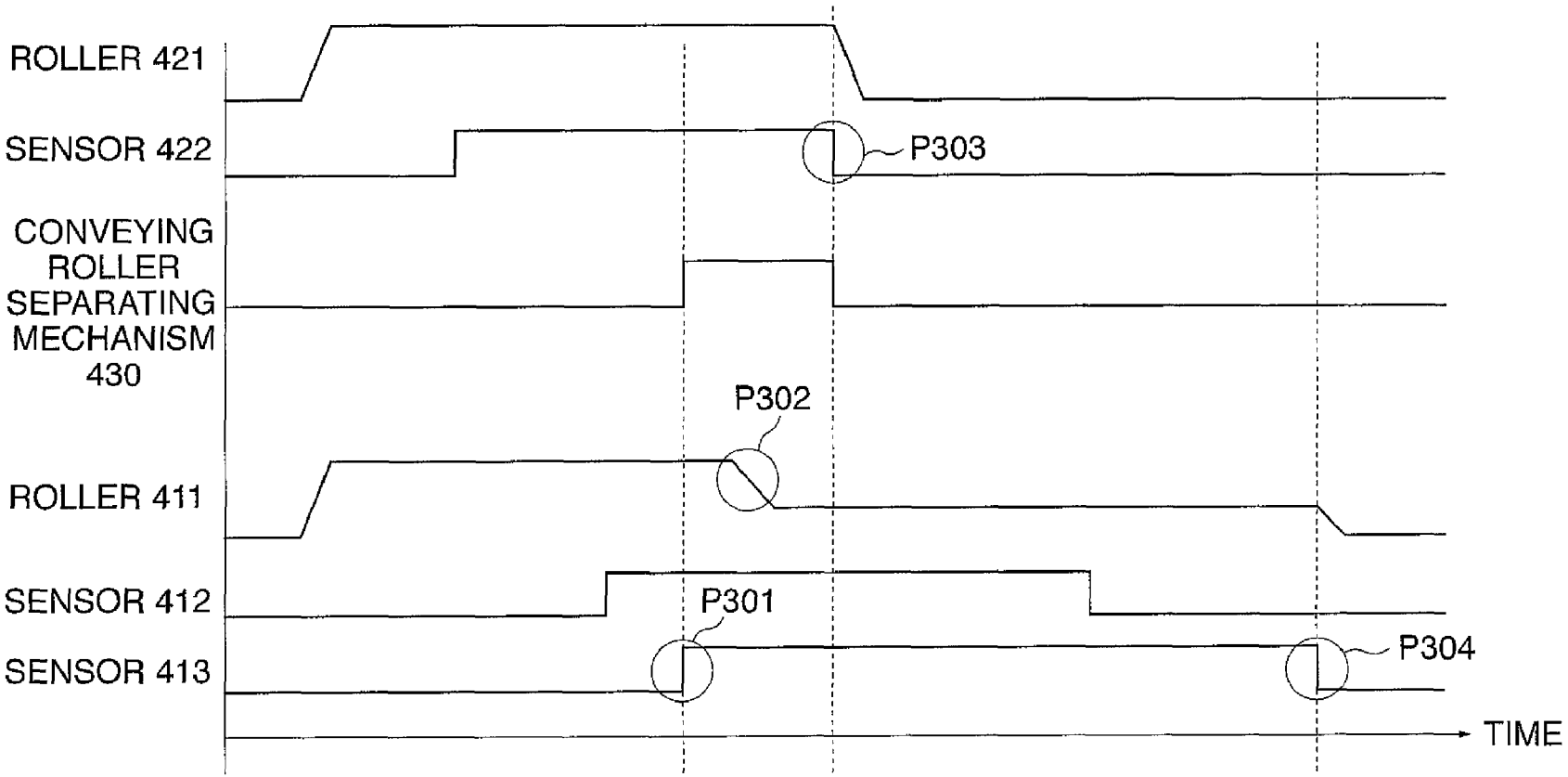
FIG. 3 is a timing chart showing an operation for passing a sheet.

FIG. 1 is a diagram illustrating a sheet conveying system according to a first embodiment of the present invention. FIGS. 2A to 2C are diagrams illustrating an operation of the sheet conveying system shown in FIG. 1. FIG. 3 is a timing chart showing an operation for passing a sheet.

Figure 4:
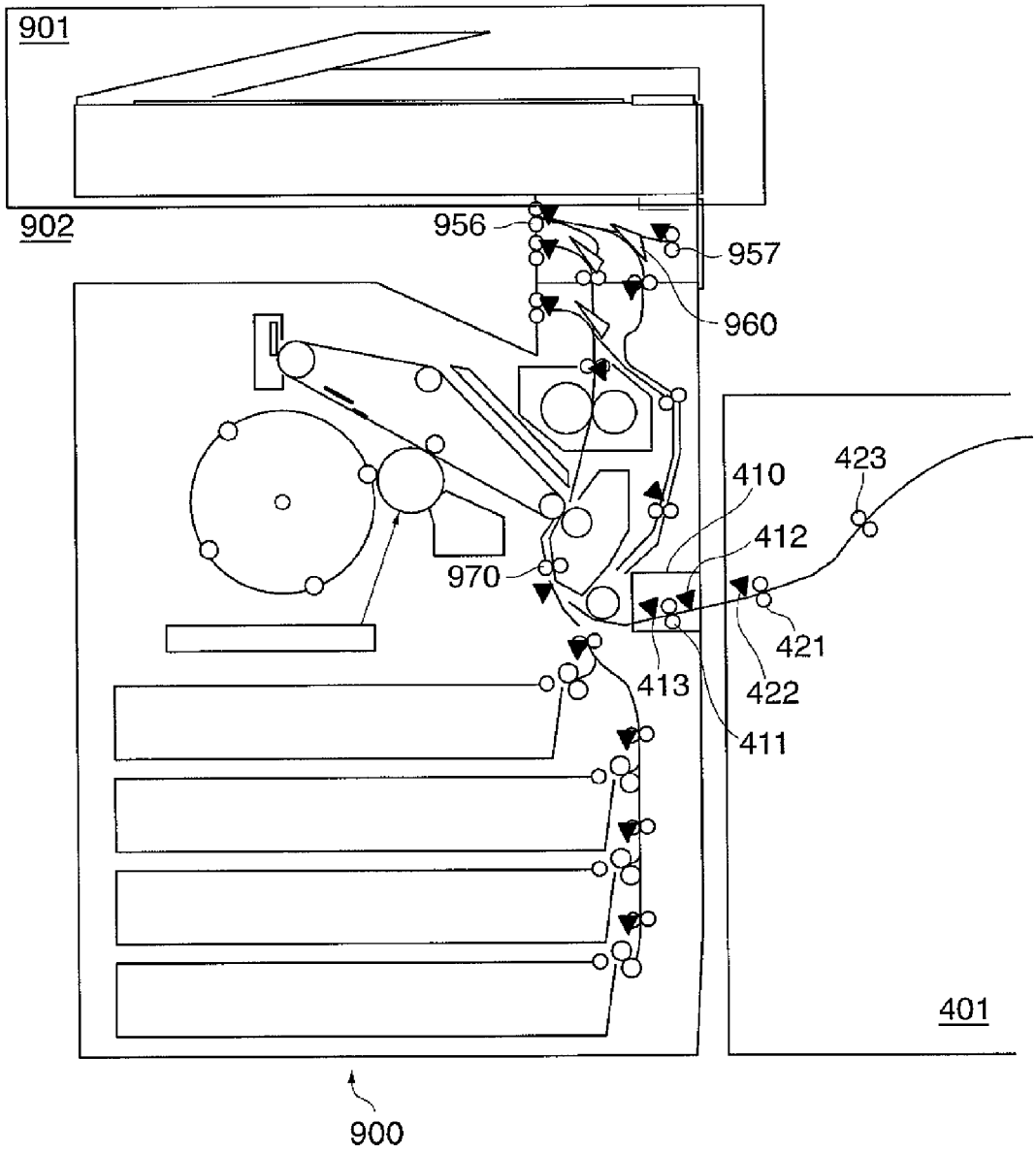
FIG. 4 is a schematic diagram showing a color image forming apparatus coupled with an optional paper deck.
Figure 5:
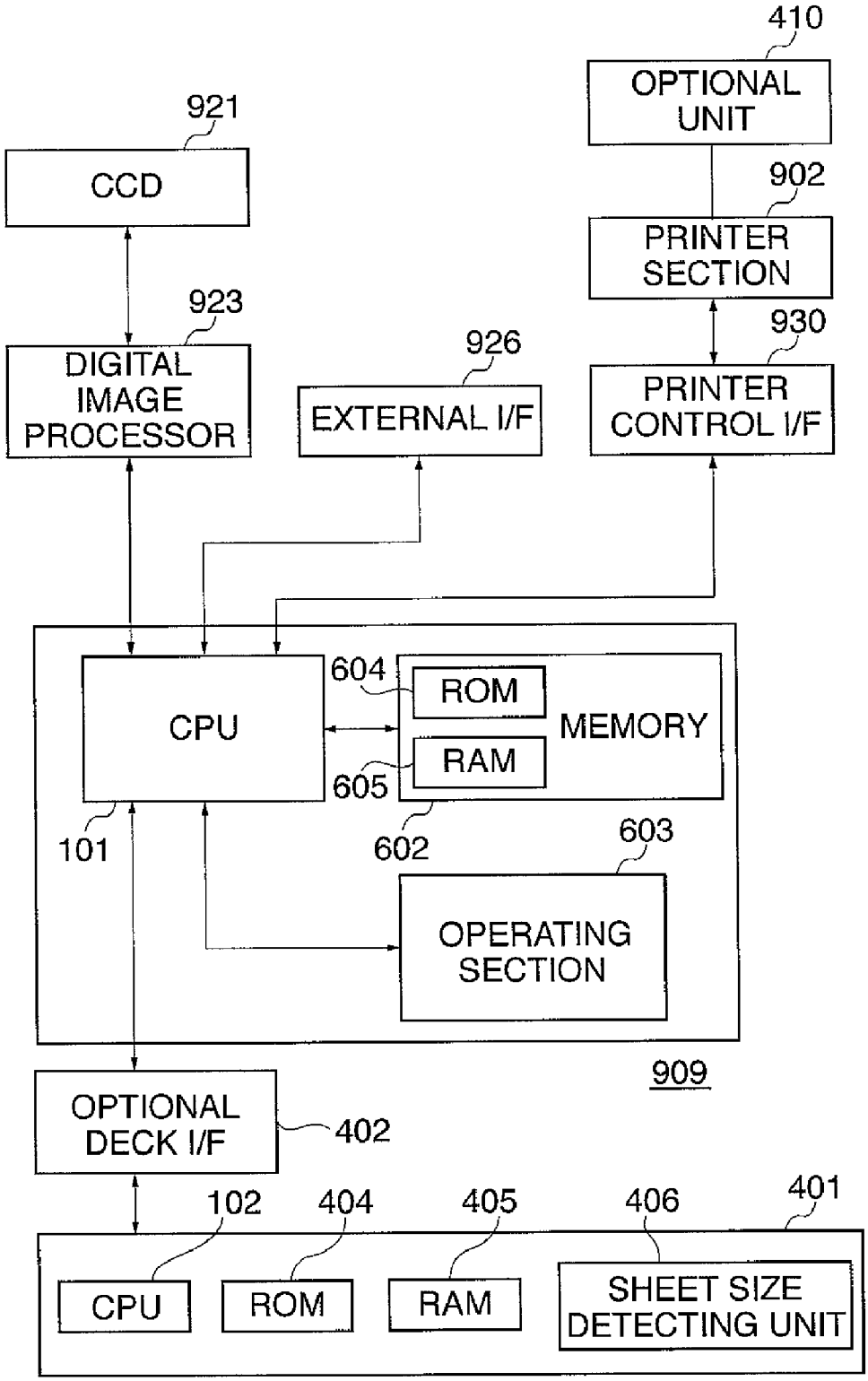
FIG. 5 is a block diagram illustrating connection between a controller of a printer section and a reader section, all of which are included in the color image forming apparatus shown in FIG. 4.
Figure 6:
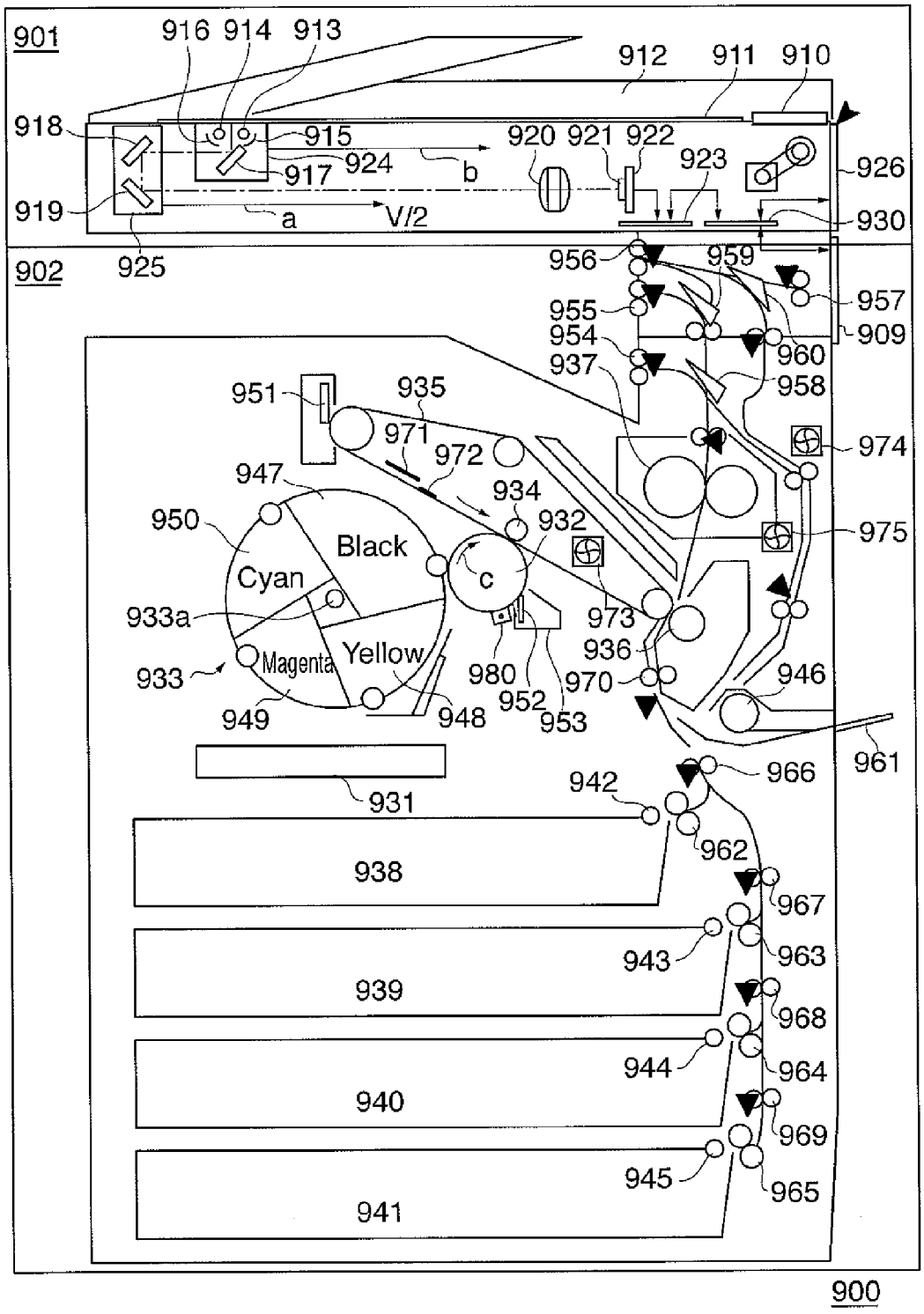
FIG. 6 is a schematic cross-sectional view schematically showing the color image forming apparatus.

FIG. 4 is a schematic diagram showing a color image forming apparatus coupled with an optional paper feed apparatus. FIG. 5 is a block diagram illustrating connection between a controller of a printer section and a reader section, all of which are included in the color image forming apparatus shown in FIG. 4. FIG. 6 is a schematic cross-sectional view schematically showing the color image forming apparatus.

The color image forming apparatus which represents a second sheet conveying apparatus of the present invention will be described first with reference to FIG. 6 for convenience of explanation.

The color image forming apparatus (the second sheet conveying apparatus) 900 includes a reader section 901 arranged at its top and a printer section 902 arranged at its bottom.

Provided in the reader section 901 are components such as a CCD 921, a substrate 922 on which the CCD 921 is mounted, a digital image processor 923, a platen 911, a document feeder (DF) 912, mirrors 918 and 919, and light sources 913 and 914.

The light sources 913 and 914 have reflection umbrella 915 and 916, respectively, for converging light onto an original. The light source 914 and reflection umbrella 915 and 916 are contained in a carriage 924 together with a mirror 917. The mirrors 918 and 919 are contained in a carriage 925.

The carriage 924 moves at a velocity of V and the carriage 925 moves at a velocity of V/2 in the direction (in the direction indicated by arrows "a" and "b" in FIG. 6) perpendicular to the electric scanning (main scanning) direction of the CCD 921 to scan (sub-scan) throughout the surface of an original on the platen 911.

A lens 920 is arranged in the vicinity of the CCD 921 that converges light reflected from an original or projected light onto the CCD 921. The original on the platen 911 reflects light emitted from the light sources 913 and 914. The reflected light is guided to the CCD 921, where it is converted into an electric signal, and the converted electric signal (analog image signal) is output to a digital image processor 923, where image processing is performed.

Also provided in the reader section 901 are a controller 910, an external interface (I/F) 926 that provides an interface to an external device such as a computer, an external interface (I/F) that provides an interface to another device, and a printer control interface (I/F) 930.

Provided in the printer section 902 are a laser scanner 931, a photosensitive drum 932, an electrostatic charger 980, a rotary developing device 933, a cleaning blade 951, a blade 952, a waste toner box 953, and cassettes 938 to 941. The rotary developing device 933 has developing devices 947 to 950.

Also provided in the printer section 902 are a primary transfer roller 934, an intermediate transfer member 935, a secondary transfer roller 936, a pressure roller 937, pickup rollers 942 to 945, a manual feed roller 946, a first discharge roller 954, and a second discharge roller 955.

Further provided in the printer section 902 are an inverting roller 956, a third discharge roller 957, a first discharge flapper 958, a second discharge flapper 959, a third discharge flapper 960, a manual feed sheet tray 961, and feed rollers 962 to 965.

Also provided in the printer section 902 are vertical path conveying rollers 966 to 969, a registration roller 970, an HP (home position for the intermediate transfer member 935) sensor 971, a mark 972 indicating the HP, and a controller 909.

As shown in FIG. 5, the controller 909 includes a CPU 101, an operating section 603, and a memory 602. The CPU 101 has an interface for communicating information to and from components of the reader section 901, such as the digital image processor 923, the printer control interface 930, and the external interface 926, and an optional paper deck interface 402. Thereby the CPU 101 controls these components respectively.

The memory 602 includes a RAM 605 which provides a work area for the CPU 101 and a ROM 604 which stores a control program of controlling the CPU 101.

The user operating section 603 includes a liquid-crystal display equipped with a touch panel which is used by an operator to input instructions to execute processing, and notifies information concerning processing and alerts to the operator, etc.

An optional paper feed apparatus (first sheet conveying apparatus) 401 (hereinafter referred to as the "optional paper deck 401") includes a CPU 102, a ROM 404, and RAM 405, as will be described later.

A control signal from the CPU 101 of the controller 909 is received at the printer control interface 930, and the printer section 902 operates in accordance with the control signal from the printer control interface 930.

The surface of the photosensitive drum 932 is uniformly charged by the electrostatic charger 980 and an electrostatic latent image of each color component is formed on the photosensitive drum 932 in accordance with an image exposure pattern by a laser beam emitted from the laser scanner 931.

The photosensitive drum 932 is 130 mm in diameter and is set so that the photosensitive drum 932 rotates in the direction indicated by arrow "c" at 137 mm/seconds in the present embodiment. The surface of the photosensitive drum 932 is charged to an electric potential in the range between −300 V and −900 V by the electrostatic charger 980 and the surface electric potential is monitored with an electric potential sensor, not shown.

The rotary developing device 933 has developing devices 947 to 950 arranged around the rotation shaft 933*a* and corresponding to black, yellow, magenta, and cyan, respectively. In the present embodiment, the developing devices 947 to 950 are readily detachable from the rotary developing device 933 and each of the developing devices 947 to 950 is attached in a specified position in accordance with the specified color.

When a black monochrome image is to be developed to form a toner image on the photosensitive drum 932, only the black developing device 947 is used and the rotary developing device 933 is rotated to the position at which the developing sleeve of the black developing device 947 faces the photosensitive drum 932.

Then, toner is transferred from the black developing device 947 to the surface of the photosensitive drum 932, in an amount corresponding to an electric potential difference between the surface of the photosensitive drum 932 on which an electrostatic latent image is formed and the surface of the developing sleeve to which a developing bias is applied, whereby the electrostatic latent image on the surface of the photosensitive drum 932 is developed.

When a color image is to be formed, the rotary developing device 933 is rotated by a stepping motor (not shown), to thereby selectively bring one of the developing devices 947 to 950 closer to (or into contact with) the photosensitive drum 932 according to an associated color component to be developed, thereby developing an image. The toner image formed on the photosensitive drum 932 is primary-transferred to the intermediate transfer member 935.

A sheet in one of the cassettes 938 to 941 is picked up by the associated pickup roller 942 to 945 and is then conveyed to the registration roller 970 through the associated feed rollers 962 to 965 and vertical path conveying rollers 966 to 969. In the case of manual feed, a sheet stacked in the manual feed sheet tray 961 is conveyed to the registration roller 970 by the manual feed roller 946.

At the timing of completion of the transfer to the intermediate transfer member 935, the sheet is conveyed to between the intermediate transfer member 935 and the secondary transfer roller 936. Then the sheet passes between the secondary transfer roller 936 and the intermediate transfer member 935 and the toner image is secondary-transferred from the intermediate transfer member 935 to the sheet.

The toner image transferred onto the sheet is heated and pressed by fixing roller (not shown) and pressure roller 937, and the image is fixed on the sheet. Residual toner that has not been transferred to the sheet and remains on the intermediate transfer member 935 is scraped off the surface of the intermediated transfer member 935 with the cleaning blade 951 that rubs the surface under post-processing control at the later stage of the image formation sequence, thereby cleaning the surface of the intermediate transfer member 935.

On the other hand, toner remaining on the surface of the photosensitive drum 932 is scraped by the blade 952 and is conveyed to the waste toner box 953 integrated with the photosensitive drum 932.

In a first discharge mode, the first discharge flapper 958 is switched to the direction of the first discharge roller 954, so that the sheet on which the image is fixed is discharged toward the first discharge roller 954.

In a second discharge mode, the first and second discharge flappers 958 and 959 are switched to the direction of the second discharge roller 955 so that the sheet is discharged toward the second discharge roller 955.

In a third discharge mode, the first and second discharge flappers 958 and 959 are switched to the direction of the inverting roller 956 so that the sheet is first inverted by the inverting roller 956. After the sheet is inverted by the inverting roller 956, the third discharge flapper 960 is switched to the direction of the third discharge roller 957 so that the sheet is discharged toward the third discharge roller 957.

In a double-sided discharge mode, the sheet is first inverted by the inverting roller 956 as in the third discharge mode. Then, the third discharge flapper 960 is switched to the direction of a double-sided unit (not shown) and the sheet having an image formed on a first side is conveyed to the double-sided unit. When a predetermined time period has elapsed after the sheet was detected by a double-sided sensor (not shown), the conveyance of the sheet is temporarily stopped. As soon as the image forming apparatus becomes ready for the subsequent image forming sequence, the sheet is fed again, whereafter a toner image is formed on a second side of the sheet.

A sheet conveying system, which is one exemplary embodiment of the present invention, will be described with reference to FIGS. 1 to 4 and 7.

FIG. 4 shows an example in which the optional paper deck 401 capable of holding 5,000 sheets of paper is coupled to a color image forming apparatus (second sheet conveying apparatus) 900.

When the optional paper deck 401 is coupled to the color image forming apparatus 900, an optional unit 410 for receiving sheets conveyed from the optional paper deck 401 is attached to a sheet tray 961 (see FIG. 6) of the color image forming apparatus 900. The optional unit 410 is controlled by the CPU 901 of the image forming unit 900.

A conveying roller pair 411 and sensors 412 and 413 for detecting a sheet are provided in the optional unit 410. A conveying roller pair 423, another conveying roller pair 421 and a sensor 422 for detecting a sheet are provided in the optional paper deck 401. The sensors 422, 412, and 413 detect position of the sheet to be conveyed.

A sheet fed from a cassette (not shown) of the optional paper deck 401 passes through the conveying roller pairs 423 and 421 and is passed to the color image forming apparatus 900 through the sheet inlet of the optional unit 410.

If the image forming speed (sheet conveying velocity) of the color image forming apparatus 900 is slower than the sheet feeding speed of the optional paper deck 401, the difference in speed between them must be accommodated. That is, control must be performed that reduces the sheet conveying velocity or stops sheet conveyance immediately after the optional unit 410 receives the sheet from the optional paper deck 401.

An example in which this control is implemented will be described with reference to FIG. 1.

A CPU (a second controller) 101 in FIG. 1 is a controller that controls the conveying roller pair (a second conveying roller pair) 411. A CPU (first controller) 102 is a controller that controls the conveying roller pair (a first conveying roller pair) 412. The CPUs 101 and 102 transmit and receive signals each other through a communication line 103.

While the communication line 103 used in this example is a well-known ARCNET line, the communication line 103 is not limited to ARCNET, but it may be any means that enables the CPUs 101 and 102 to communicate with each other.

A conveying roller separating mechanism 430 (releasing mechanism) is provided for the conveying roller pair 421 of the optional paper deck 401. A well-known technology is used for the structure of the conveying roller separating mechanism 430 and therefore the description of the structure will be omitted. The conveying roller separating mechanism 430 is controlled by the CPU 102 which is operated based on instructions of the CPU 101.

FIG. 2A shows a state in which the front end of a sheet P being conveyed in the optional paper deck 401 has reached the sheet discharge section of the optional paper deck 401. In this state, the conveying roller pairs 421 and 411 are controlled so that they convey the sheet at a constant speed.

FIG. 2B shows a state in which the front end of the sheet P has reached the sheet feed section of the optional unit 410 and the sensor 412 is turned on. In this state, the sheet P is not yet nipped by conveying the roller pair 411 of the optional unit 410 and is nipped and conveyed by the conveying roller pair 421 of the optional paper deck 401.

Then, the sheet P is nipped by the conveying roller pair 411 of the optional unit 410. Thereafter, when the front end of the sheet P is detected by the sensor 413, the detected state of the sensor 413 switches from off mode to on mode as shown in FIG. 2C. When the detected state of the sensor 413 set to on mode, the CPU 101 recognizes that the sheet P is firmly nipped by the conveying roller pair 411 of the optional unit 410.

Figure 7:
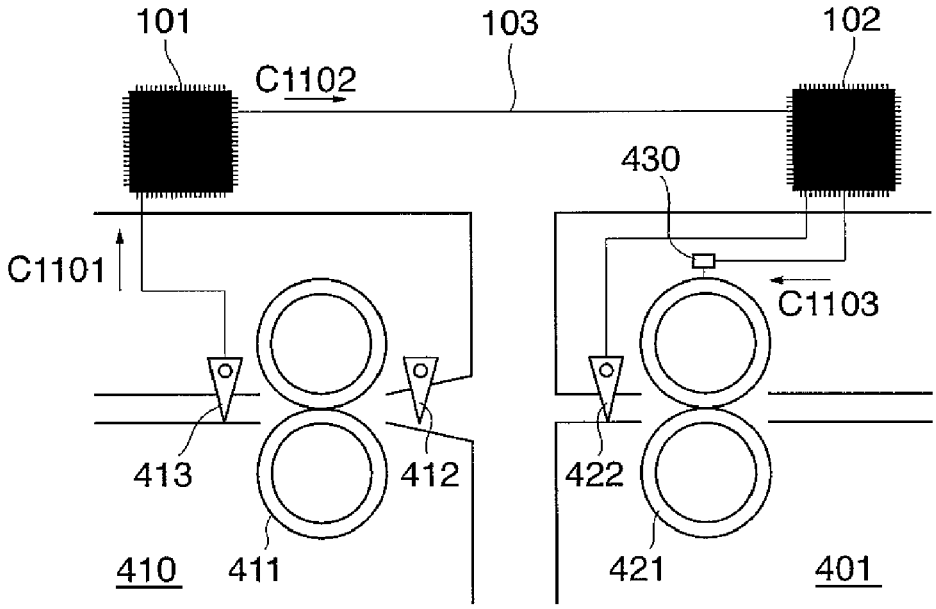
FIG. 7 is a diagram illustrating an example of control for separating a conveying roller pair.

Subsequently, the CPU 101 transmits an instruction of controlling the conveying roller separating mechanism 430 to the CPU 102 (FIG. 7). The CPU 102 receiving the instruction separates the conveying roller pair 421 by controlling the conveying roller separating mechanism 430. Because the conveying roller pair 421 of the optional paper deck 401 are separated in this way, the conveyance of the sheet P is controlled in synchronization with the nipping by the conveying roller pair 411 of the optional unit 410 (see P301 in FIG. 3).

Thus, the conveying roller pair 411 can be smoothly controlled to reduce the conveying velocity on the optional unit 410 side and damage to the sheet P which would otherwise be caused by a difference in conveying velocity between the optional paper deck 401 and the optional unit 410 can be prevented.

The CPU 102 detects the off mode of the sensor 422 (absence of a sheet) and determines that the sheet P has passed through the conveying roller pair 421, and therefore releases the separation of the conveying roller pair 421 and stops driving thereof (see P303 in FIG. 3).

Figure 2D:
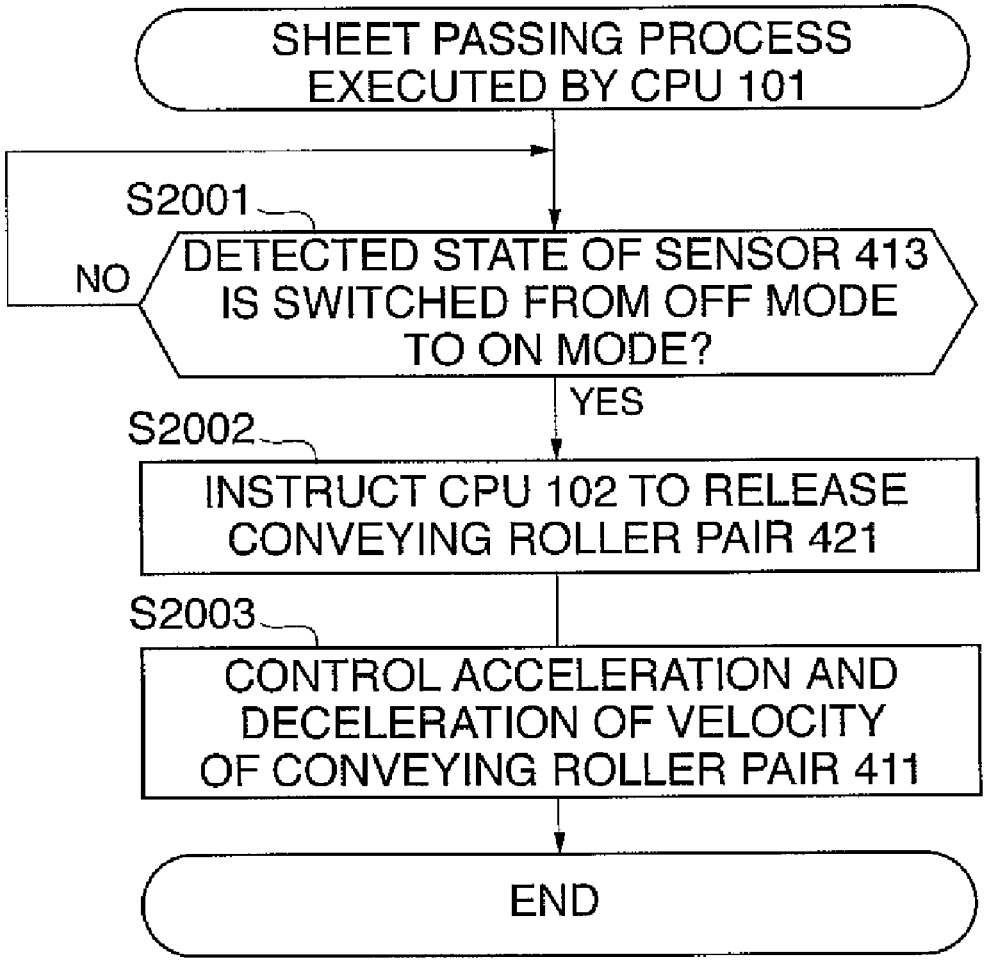
Figure 2E:
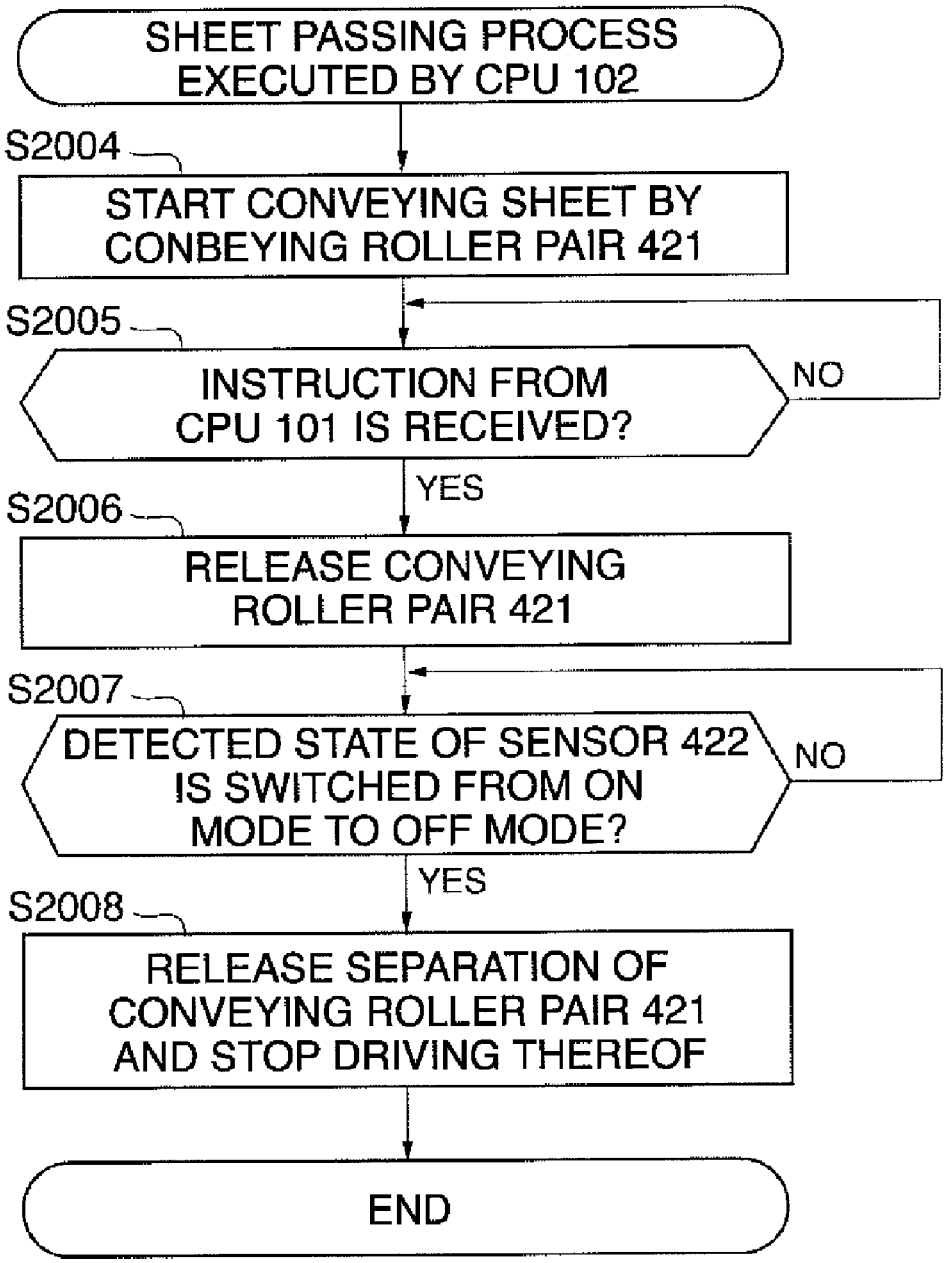

Referring to FIGS. 7, 2D, and 2E, an example will be described next in which the CPU 101 controls the separating mechanism through the CPU 102. The procedures of a sheet passing process shown in the following flowcharts of FIGS. 2D and 2E are respectively executed by the CPUs 101 and 102 based on a program stored in the ROM 604.

The CPU 102 first starts conveying a sheet by controlling the conveying roller pair 421 (step S2004 in FIG. 2E). Then, when the CPU 101 detects the front end of the sheet with the sensor 413 (the CPU 101 receives C1101) (YES to step S2001 in FIG. 2D), the CPU 101 outputs a request (C1102) for causing the conveying roller separating mechanism 403 to release nipping to the CPU 102 through a communication line 103 (step S2002 in FIG. 2D). In response to the request (YES to step S2005 in FIG. 2E), the CPU 102 controls (outputs C1103) the conveying roller separating mechanism 430 to separate the conveying roller pair 421 (step S2006 in FIG. 2E). Then, the CPU 101 controls acceleration and deceleration of the velocity of the conveying roller pair 411 (step S2003 in FIG. 2D).

Thus, when a sheet is passed from a sheet conveying apparatus having a sheet conveyance controller to another sheet conveying apparatus having a sheet conveyance controller, the receiving apparatus can smoothly control acceleration, deceleration, or stop of conveyance of the sheet. Consequently, damage to a sheet being conveyed such as a bend or tear can be prevented.

After that, when the detected state of the sensor 422 switches from on mode to off mode (YES to step S2007 in FIG. 2E), the CPU 102 releases the separation of the conveying roller pair 421 and stops driving thereof (step S2008 in FIG. 2E). Thus, the conveying roller pair 421 can prepare for conveying the next sheet smoothly as soon as it finishes conveying the sheet P.

As the velocity of conveying the sheet is faster, the conveying roller separating mechanism 430 of the optional paper deck 401 needs to be controlled promptly to separate the conveying roller pair 421 as soon as the sensor 413 detects the front end of a sheet P.

Figure 8:
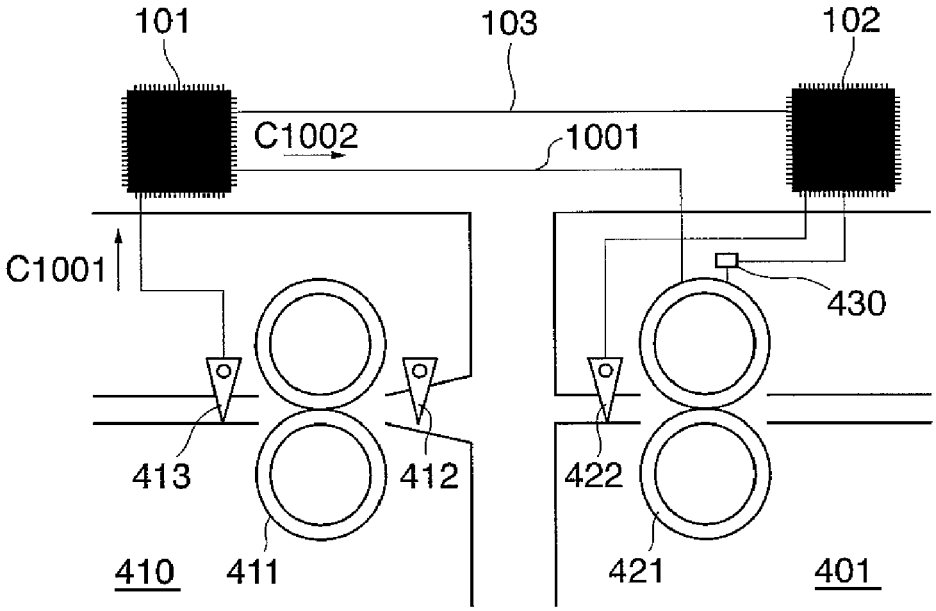
FIG. 8 is a diagram illustrating a first variation of control for separating a conveying roller pair.

Referring to FIG. 8, an example will be described in which the CPU 101 directly controls the conveying roller separating mechanism 430.

The CPU 101 of the optional unit 410 has a control signal line 1001 for directly controlling the conveying roller separating mechanism 430 for the conveying roller pair 421 of the optional paper deck 401. The conveying roller separating mechanism 430 controlling the conveying roller pair 421 receives control signals from the CPUs 101 and 102 at an OR circuit so that the conveying roller separating mechanism 430 can be controlled by both of the CPUs 101 and 102 independently.

When the CPU 101 of the optional unit 410 detects a change P301 in the signal shown in FIG. 3 described above with the sensor 413, the CPU 101 controls the conveying roller separating mechanism 430 of the optional paper deck 401 through the control signal line 1001 to separate the conveying roller pair 421.

Thus, the conveying roller pair 421 of the optional paper deck 401 can be separated in real time after the front end of a sheet P is nipped by the conveying roller pair 411 of the optional unit 410.

In this way, after a sheet P conveyed from the optional paper deck 401 to the optional unit 410 is nipped by the conveying roller pair 411, the nipping of the sheet P by the conveying roller pair 421 can be released in substantially real time in the present embodiment.

Figure 9:
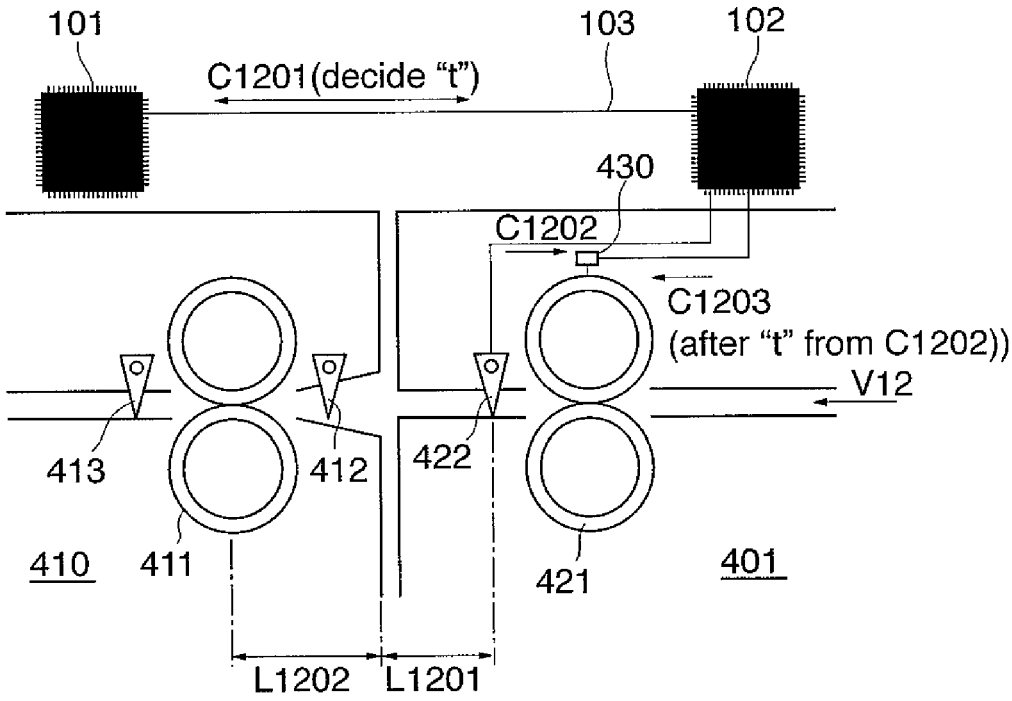
FIG. 9 is diagram illustrating a second variation of control for separating a conveying roller pair.

Referring to FIG. 9, an example will be described in which, the CPU 102, rather than the CPU 101, controls separation of the conveying roller pair 421 without being instructed by the CPU 101.

In the example shown in FIG. 9, when predetermined time "t" has elapsed after the front end of a sheet being conveyed reached the sensor 422 of the optional paper deck 401, rollers comprising of the conveying roller pair 421 are separated.

Before a sheet is passed, the CPU 101 communicates with the CPU 102 to acquire the information indicating the distance (L1202) from the sheet inlet of the optional unit 410 to the conveying roller pair 411. Thus, the CPU 102 decides the timing "t" at which the conveying roller pair 421 is to be separated (C12011).

Specifically, the time "t" is calculated on the basis of not only the distance (L1202) but also the distance (L1201) from the position of the sensor 422 of the optional paper deck 401 to the sheet outlet and the sheet conveying velocity (V12). That is, "t"=(L1201+L1202)/V12.

Then, the CPU 102 monitors the sensor 422. When the CPU 102 detects (receives C1202) that a sheet being conveyed turns on the sensor 422, the CPU 102 starts measuring time "t". When time "t" has elapsed, the CPU 102 controls (outputs C1203) the conveying roller separating mechanism 430 to separate the conveying roller pair 421.

In this example, once time "t" is predetermined between the optional unit 410 and the optional paper deck 401, the subsequent processing is performed in the optional paper deck 401.

Therefore, nipping of a sheet P by the conveying roller pair 421 can be released in real time after the sheet is nipped by the conveying roller pair 411 while the cost of the system can be reduced.

The predetermined time "t" varies depending on the types of apparatus coupled because the distances L1201, 1202 varies depending on the types. However, a common mechanism can be used for any types of sheet conveying apparatuses respectively comprising a CPU for controlling thereof coupled because the time "t" is predetermined through communication between the two CPUs of adjacent sheet conveying apparatuses.

While the embodiment above is described with respect to the example in which nipping of a sheet by the conveying roller pair 421 nearest to the sheet outlet of the optional paper deck 401 is released, nipping of a sheet by another conveying roller pair of the optional paper deck 401, in addition to the conveying roller pair 421, may be released.

For example, assuming that a conveying roller separating mechanism (second releasing mechanism), not shown, may also be provided for a conveying roller pair 423 (see FIG. 4) of the optional paper deck 401. When a sheet longer than the distance from the conveying roller pair 411 of the optional unit 410 to the conveying roller pair 423 of the optional paper deck 401 is conveyed, both of the conveying roller pairs 421 and 423 may be separated at the same time. The size of the sheet can be detected by a sheet size detecting unit 406 provided in the optional paper deck 401.

The conveying roller separating mechanism for the conveying roller pair 423 is controlled in the same way that the conveying roller separating mechanism 430 associated with the conveying roller pair 421 is controlled. Separation of the conveying roller pair 423 may be controlled by the CPU 101 or the CPU 102, as described above.

When a sheet shorter than the distance from the conveying roller pair 411 of the optional unit 410 to the conveying roller pair 423 of the optional paper deck 401 is conveyed, rollers comprising of the conveying roller pair 421 are separated and rollers comprising of the conveying roller pair 423 are not separated. By selecting and controlling a conveying roller pair to release nipping of a sheet in this way, extra power consumption can be avoided.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2006-262720 filed Sep. 27, 2006, which is hereby incorporated by reference herein in its entirety.

What is claimed is:

1. A sheet conveying system comprising:

a first sheet conveying device including a first conveying roller pair adapted to nip and convey a sheet, a first releasing mechanism adapted to release nipping of the sheet by said first conveying roller pair, a third conveying roller pair disposed upstream from said first conveying roller pair, a second releasing mechanism adapted to release nipping of a sheet by said third conveying roller pair, and a first controller adapted to control said first conveying roller pair and said first releasing mechanism;

a second sheet conveying device including a second conveying roller pair adapted to nip and convey the sheet conveyed by said first sheet conveying device, a second controller adapted to control said second conveying roller pair, and a detecting device adapted to detect position of a sheet; and a size detecting device adapted to detect a size of the sheet, wherein in response to the detection by said detecting device, said second controller is adapted to cause said first releasing mechanism to release the nipping of the sheet by said first conveying roller pair, said second controller is adapted to cause said second releasing mechanism to release nipping of a sheet by said third conveying roller pair when said first releasing mechanism releases the nipping of the sheet by said first conveying roller pair, and wherein when the size of the sheet detected by said size detecting device is shorter than a distance from said first conveying roller pair to said third conveying roller pair, said second controller is adapted to stop causing said second releasing mechanism to release the nipping of a sheet.

2. The sheet conveying system according to claim 1, further comprising a communicating device adapted to communicate between said first controller and said second controller, wherein said second controller is adapted to transmit an instruction of controlling said first controller to operate said first releasing mechanism via said communicating device.

3. The sheet conveying system according to claim 1, wherein said first releasing mechanism is adapted to separate said first conveying roller pair to release the nipping of the sheet.

4. The sheet conveying system according to claim 1, wherein after the nipping of the sheet by said first conveying roller pair is released by said first releasing mechanism, said second controller is adapted to decelerate or stop said second conveying roller pair.

* * * * *